United States Patent [19]

Birdwell

[11] 4,026,548

[45] May 31, 1977

[54] SPRING TYPE EXERCISE DEVICE

[76] Inventor: Daniel Lee Birdwell, 212 Burlington Lane, Huntington Beach, Calif. 92636

[22] Filed: July 2, 1975

[21] Appl. No.: 592,560

[52] U.S. Cl. ..... 272/136; 272/142; 272/94; 272/70; 272/143; 272/900

[51] Int. Cl.[2] ..... A63B 21/04

[58] Field of Search ..... 272/83 R, 82, 79 R, 272/80, 136–138, 140–142, 83, 143, 120, 121, 125, 128, 79, 94, 126, 139

[56] References Cited

UNITED STATES PATENTS

| | | | |
|---|---|---|---|
| 1,023,756 | 4/1912 | Pons | 272/83 R |
| 3,041,060 | 6/1962 | Jacobsen | 267/73 X |
| 3,343,837 | 9/1967 | Grzybowski | 272/83 R |
| 3,659,846 | 5/1972 | Kanicki | 272/83 R X |

*Primary Examiner*—Richard C. Pinkham
*Assistant Examiner*—William R. Browne
*Attorney, Agent, or Firm*—Fulwider, Patton, Rieber, Lee & Utecht

[57] ABSTRACT

An exercise device including a pair of longitudinally extensible and retractable members, one adapted for attachment to a fixed object or structure, and the other adapted for coupling to an individual by a harness or belt. It is especially useful for in-place jogging exercises. A spring is interposed between the members and provides resistance to their extension. The spring is attached to one member and is connected to the other member by an adjuster. The adjuster's position along the length of the spring can be varied to thereby vary the number of turns of the spring subjected to tension during relative extension of the members.

6 Claims, 6 Drawing Figures

FIG. 1
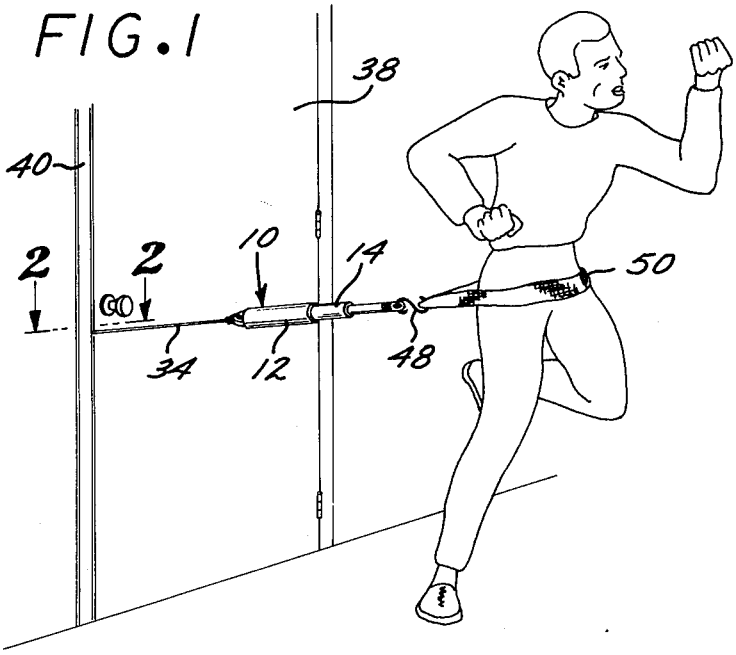
FIG. 2
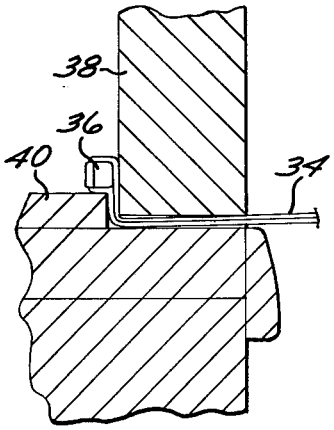
FIG. 3
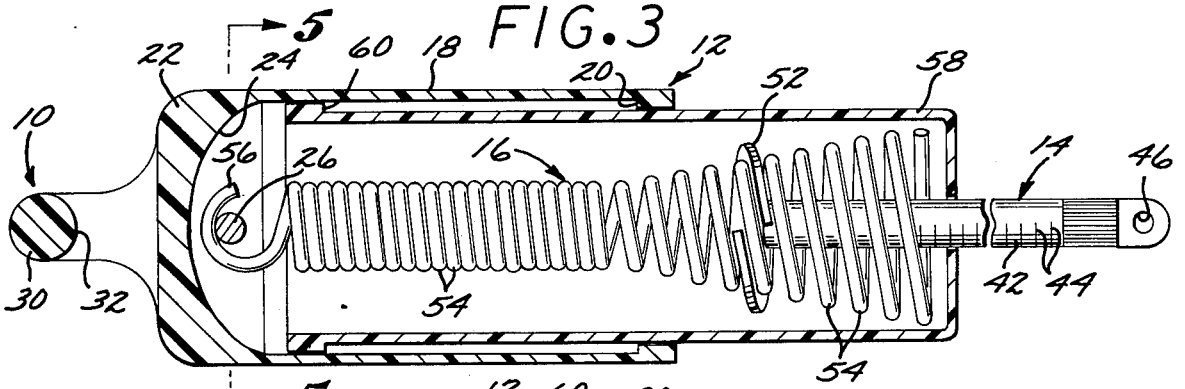
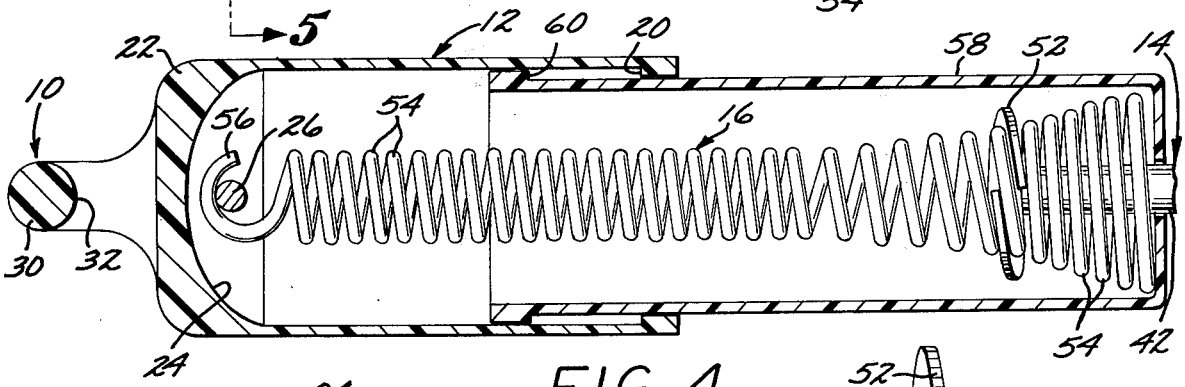
FIG. 4
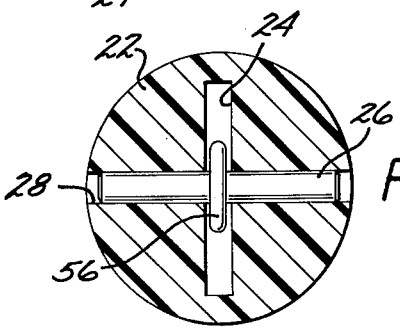
FIG. 5
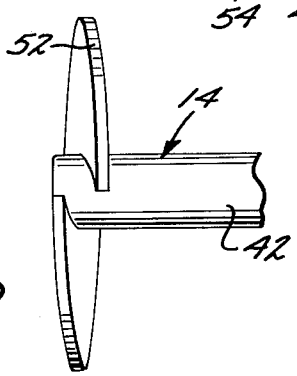
FIG. 6

SPRING TYPE EXERCISE DEVICE

BACKGROUND OF THE INVENTION

1. Field of the Invention

The present invention relates to an exercise device for in-place jogging and the like, and is characterized by a pair of members whose extension is resisted by an adjustable bias force.

2. Description of the Prior Art.

Jogging and similar running exercises are recognized as aerobic exercises particularly beneficial to the cardio-vascular system. Attempts have been made to augment the benefits of such exercises by providing some kind of contraint against the jogger. With such an arrangement other muscle groups of the body are also developed. One such exercising device develops the desired constraint by utilizing a line attached to a fixed object and trained through a friction element. As the individual pulls upon the line and jogs away from the fixed object, the line is constrained by the friction element. The degree of constraint is adjustable. Unfortunately, the exercise can only be continued up to the length of the attachment line. Consequently, the exercise cannot be continuous.

Other in-place jogging devices simply require attachment of a line to the person and to some heavy object, which is then dragged over the floor or other supporting surfaces.

None of these devices provides a simple and economical means for modifying the usual continuous, in-place jogging exercise to development of various other muscle groups of the body.

SUMMARY OF THE INVENTION

According to the present invention, an exercise device is provided which comprises a pair of members which are longitudinally extensible and retractable relative to one another. One of the members is adapted for attachment to a fixed anchorage, while the other is adapted for attachment by a harness, belt or the like to the exercising individual. A bias or spring means is interposed between these first and second members, and it is characterized by a plurality of helical turns. One end of the spring is attached to one member, while the other end is engaged by an adjuster portion carried by the other member. The position of the adjuster portion along the length of the spring can be changed to thereby adjust the bias developed during the exercise.

The present exercise device is particularly useful for in-place jogging, and for analogous exercises by swimmers and others, as will be apparent to those skilled in the art.

The device preferably includes stop means to prevent overextension, and also a housing or shield over the members for engagement of the end of the spring adjacent the adjuster portion of the device. Such engagement develops a compressive force upon the attainment of full extension of the members.

The location of the adjuster portion along the length of the spring is displayed on a suitable scale to apprise the user of the approximate level of effort required to extend the members.

Other objects and features of the invention will become apparent from consideration of the following description taken in connection with the accompanying drawings.

BRIEF DESCRIPTION OF THE DRAWINGS

FIG. 1 is a perspective view of the exercise device of the present invention, as it would be used for in-place jogging;

FIG. 2 is an enlarged detail view along the line 2—2 of FIG. 1;

FIG. 3 is an enlarged longitudinal cross sectional view of the exercise device without the harness and attachment means, and illustrating the relatively extensible members in their retracted positions;

FIG. 4 is a view similar to FIG. 3, but illustrating the members in more extended positions;

FIG. 5 is a view taken along the line 5—5 of FIG. 3; and

FIG. 6 is an enlarged side-elevational view of the adjuster portion of the device.

DESCRIPTION OF THE PREFERRED EMBODIMENT

Referring now to the drawings, an exercising device 10 is illustrated which, according to the present invention, comprises, generally, first and second members 12 and 14 which are longitudinally extensible and retractable relative to one another; and a bias means or spring 16 adapted to develop a bias resisting relative extension of the members 12 and 14 during use of the device 10 in a jogging or analogous exercise. As more particularly described hereinafter, the members 12 and 14 are also rotatable relative to one another about their longitudinal axes.

Although device 10 will be described in conjunction with in-place jogging exercises, it will be apparent to those skilled in the art that the device can also be used by a swimmer swimming against the constraint of the device 10, or in similar fashion by individuals engaged in other forms of exercise.

FIG. 1 illustrates a typical in-place jogging exercise, in which the individual jogs in the usual manner, but with the added exercise of leaning forwardly and jogging against the constraint or bias offered by the device 10. This has the desirable effect of providing development of muscle groups not exercised in the normal in-place jogging exercise. It is a natural consequence of jogging against the constraint of the device 10, as compared with jogging freely. The muscle groups exercised can be varied by changing the location of the harness or belt by which the device is attached to the exerciser. It can be worn, for example, about the waist, or the hips, or the chest, or the head. As will be seen, the degree of the bias or constraint offered by the device during exercising is easily varied so that the device 10 is suited for use by individuals of differing physical strengths.

The first member 12 preferably takes the form of an elongated cylindrical casing 18 having a radially inwardly directed collar or ridge at one end which defines a circumferential stop 20. The other end of the casing 18 is closed and includes a thicker end section 22 having a diametrically disposed arcuate inner groove or recess 24.

A pin 26 is disposed through a suitable transverse opening 28 which is provided in the end section 22 in intersection with the recess 24. As will be seen, the pin 26 provides an anchorage for one end of the spring 16. Various other end attachments for the spring 16 could be used, as will be apparent.

The end section 22 includes an integral ring portion 30 which defines an eye 32. Although the exercise device 10 can be reversed end-for-end, the end which includes the eye 32 is normally the end oriented toward a door jamb or similar anchorage. A strap or line 34 is disposed through the eye 32 and is suitably secured or attached to a wedge or block 36. The block 36, when placed behind the door 38, is held in place between the door 38 and the jamb 40 when the door 38 is shut, as best seen in FIG. 2. The line or strap 34 extends through the crevice or space between the door 38 and jamb 40, although the device 10 could also be arranged so that the strap extends through the crevice at the hinge edge of the door.

The second member 14 preferably takes the form of an elongated rod 42 provided with a series of graduations 44 to indicate the degree of extension of the number 14 relative to the other components of the device 10, as will be seen. One extremity of the rod 42 includes an eye 46 adapted to receive an S-shaped hook 48, as seen in FIG. 1. The hook 48 is adapted to be attached to a coupling means such as a harness or belt 50 which is disposed about the torso of the individual.

As best seen in FIG. 6, the end of the rod 42 opposite the eye 46 is provided with an adjuster portion 52 in the form of a helical plate characterized by a pitch or lead enabling it to be rotated for advancement along the length of the spring 16 for location between a selected pair of the plurality of helically extending turns 54 of the spring.

A hook 56 on the end of spring 16 is disposed about the pin 26 to secure the spring 16 to the first member 12. The turns 54 adjacent the hook 56, and extending to approximately the mid-portion of the spring 16 are preferably approximately the same in size and diameter, as best seen in FIG. 3. From the middle of the spring and toward its opposite end the turns 54 progressively increase in diameter to provide a progressively changing spring constant, depending upon the turns 54 thereof which are engaged by the adjuster portion 52, as will be apparent.

The end of the spring 16 opposite the hook 56 is adapted to rest against the closed end of a cylindrical casing 58 which is slidably telescopically within the casing 18 of the first member 12. If desired, the spring 16 could be attached in any suitable fashion to the end of the casing 18.

The casing 58 includes a radially outwardly oriented ridge or collar which defines a stop 60 engagable with the stop 20 in the fully extended position of the casing 58 relative to the casing 18. The closed end of the casing 58 is provided with a central opening through which the graduated shank of the rod 42 is disposed.

The bias force developed by the spring 16 is adjusted by rotation of the rod 42 inwardly or outwardly, which adjusts the location of the adjuster portion 52 between the spring turns 54.

In operation, the block 36 is disposed between the door 38 and the jamb 40, or any other suitable means is employed to fix the line 34 to stationary structure. The rod 14 is next rotated to select the particular spring force desired, turning it inwardly to increase the force, or outwardly to decrease the force. The belt 50 is then arranged in the desired position, and the individual leans forwardly against the bias of spring 16 and begins to jog in place.

During the exercise the spring turns 54 located between the adjuster portion 52 and the pin 26 are placed in tension. The stops 20 and 60 will come into engagement to prevent overextension of the device 10. If such engagement occurs, a limited degree of further extension is possible, in which case the spring turns 54 located between the adjuster portion 52 and the closed end of the casing 58 are placed in compression, adding additional resistance.

With the foregoing arrangement, an individual is able to quickly mount the device 10 to any suitable stationary structure, adjust the level of effort required for his particular exercise comfort range, simply lean against the constraint of the device, and jog in place in simulation of uphill running. The muscle groups exercised can be varied by changing the location of the harness or belt, as will be apparent.

Various modifications and changes may be made with regard to the foregoing detailed description without departing from the spirit of the invention.

I claim:

1. An exercise device comprising:

first and second members longitudinally extensible and retractable relative to one another, one of said members being adapted for attachment to a fixed anchorage, and the other of said members being adapted for mounting upon an individual; and spring means characterized by a plurality of helical turns extending longitudinally relative to said first and second members and attached at one end to said first member, said second member including an adjuster portion adjustably disposable between selected turns of said helical turns thereby to adjust the bias developed upon extension of said first and second members, certain of said helical turns being progressively larger in diameter as they proceed in a direction away from the point of attachment of said spring means to said first member.

2. An exercise device according to claim 1 and including a third member surrounding said spring and having an end wall, certain of said helical turns being located between said end wall and said adjuster portion whereby said certain of said helical turns are subjected to compression upon extreme relative extension of said first and second members.

3. An exercise device according to claim 1 and including a third member surrounding said spring, and stop means on said third member and on said one of said first and second members adapted for attachment to a fixed anchorage, said stop means being engageable to prevent further extension upon attainment of a predetermined degree of relative extension between said first and second members.

4. An exercise device according to claim 1 wherein said adjuster portion comprises a helically directed element progressively movable along said turns upon rotation of said adjuster portion.

5. An exercise device according to claim 1 and including a third member engaged by the end of said spring opposite one end; and stop means on said first member and said third member engageable upon predetermined relative extension between said first and second members to limit further said extension.

6. An exercise device comprising:

coupling means for coupling to an individual;

first and second members longitudinally extensible and retractable relative to one another and rotatable relative to one another about their longitudinal axes, one of said first and second members being adapted for attachment to a fixed anchorage, and the other of said members being attached to said coupling means; and spring means characterized by a plurality of helical turns extending longitudinally relative to said first and second members and attached to one of said members, the other of said first and second members including a spring tension means adjuster means located between selected turns of said spring means and rotatable relative to said turns for screw-like travel of said adjuster means along the length of said spring means thereby to vary the number of said turns placed in tension upon extension of said first and second members relative to one another.

* * * * *